United States Patent [19]

Mattingly et al.

[11] Patent Number: 4,702,537

[45] Date of Patent: Oct. 27, 1987

[54] QUICK-DISCONNECT ELECTRICAL CONNECTOR COUPLING ASSEMBLY FOR USE WITH BAYONET PIN COUPLING SYSTEM

[75] Inventors: William R. Mattingly, Santa Ana; Barry R. Trombly, Torrance, both of Calif.

[73] Assignee: Matrix Science Corporation, Torrance, Calif.

[21] Appl. No.: 729,847

[22] Filed: May 3, 1985

[51] Int. Cl.[4] ..... H01R 13/62

[52] U.S. Cl. ..... 439/152; 439/350; 439/314

[58] Field of Search ..... 339/45 R, 45 M, 46, 339/DIG. 2, 88 R, 89 R, 89 C, 89 M, 90 R, 90 C, 91

[56] References Cited

U.S. PATENT DOCUMENTS

| | | | |
|---|---|---|---|
| 3,609,632 | 9/1971 | Vetter | 339/45 M |
| 4,478,473 | 10/1984 | Frear | 339/DIG. 2 |
| 4,531,802 | 7/1985 | Tomsa | 339/DIG. 2 |

FOREIGN PATENT DOCUMENTS

| | | | |
|---|---|---|---|
| 2105923 | 2/1983 | United Kingdom | 339/45 M |

*Primary Examiner*—Gil Weidenfeld
*Assistant Examiner*—David Pirlot
*Attorney, Agent, or Firm*—Nilsson, Robbins, Dalgarn, Berliner, Carson & Wurst

[57] ABSTRACT

A quick-disconnect electrical connector coupling assembly has an electrical connector plug assembly which surrounds and mates with a receptacle shell. The electrical connector plug assembly may be quickly disconnected by the application of an external axially-directed force imparted by means of remote control through the use of a lanyard affixed to the assembly. The lanyard may be attached to a ring which surrounds the connector plug assembly. The electrical connector plug assembly comprises a first coupling ring surrounded by a second coupling ring. The first coupling ring has a plurality of apertured mountings which accommodate, in each mounting, the insertion of a floating land segment positioned atop a ramp spring segment. When the coupling is fully mated, the ramp spring segments protrude radially into the inner surface of the first coupling ring and abut a plurality of fixed bayonet pins to secure the mated connection. When an axially-directed external force pulls the second coupling ring away from the receptacle shell, the floating land segments move into an annular sloped recess of the second coupling ring and drive the ramp spring segments into retraction within the first coupling ring housing. Once the ramp spring segment is fully retracted, the electrical connector plug assembly may be removed immediately from the receptacle shell without interference from the fixed bayonet pins.

14 Claims, 4 Drawing Figures

QUICK-DISCONNECT ELECTRICAL CONNECTOR COUPLING ASSEMBLY FOR USE WITH BAYONET PIN COUPLING SYSTEM

FIELD OF THE INVENTION

This invention relates to an electrical connector coupling assembly and, more particularly, to a remote control quick-disconnect electrical connector coupling assembly.

BACKGROUND OF THE INVENTION

Electrical connector coupling assemblies have a wide variety of applications in the military and civilian sectors. Such connectors are designed to operate in extreme environmental conditions such as those imposed in high altitute flight. The connectors are sealed to withstand such conditions as moisture condensation, corona, flashover, and vibrations, providing a completely environmental resistant assembly when the connector assembly halves are mated. Conventionally, a connector assembly comprises a plug and a receptacle shell and is coupled and disengaged by twisting the plug assembly along a helical pathway around the receptacle shell, by means of threads or a bayonet coupling system. However, this method of uncoupling of the connector shell assembly is not adequate for those applications where a rapid disconnect of the connector assembly is needed. A quick release mechanism relying only on an axially applied external force is used to meet such requirements.

The needs of customers such as the military may dictate the use of a lanyard attached to the connector plug assembly to apply the axially directed external force for quick disconnect. It is possible to obtain standard circular connectors with a quick-disconnect compression ring or coupler instead of a conventional coupling nut which has a threaded inner surface. The electrical connector plug assembly may be modified for quick disconnect use. In this form of quick disconnect coupler, an adapter which threads over the receptable shell provides an indented surface to mate with a compression coupler. The remote control feature of the conventional disconnect coupler may include a lanyard attached to the electrical connector plug assembly. In addition to the use of an adapter with compression couplings linking the receptable and plug portions of the electrical connector assembly, one variety of quick-release coupler assembly uses a collet or collet chuck system in which a casing or socket on the connector plug grips the connector receptacle shell. A remote control such as a lanyard may be used to open the collet allowing the connector receptable and connector plug assemblies to disengage. This form of assembly requires numerous individual parts and is of relatively precise and complicated design.

A quick release disconnect coupling assembly which functions to allow quick and remote control of the disconnect feature, but with a simplicity of design and mechanism, would be an improvement over existing art.

An additional class of quick release mechanism connector assemblies includes breakaway connectors. The electrical connector plug assembly of these connectors mates with the standard receptable and has a release mechanism to provide a breakaway function. They are used primarily to disengage fuel tanks from aircraft wings and guided missile assemblies. The relief mechanism consists essentially of an ejector spring which acts against a coupling nut. With this system, the coupling nut is retained by a ball and detent mechanism. When a lever holding the ball retaining mechanism is released, the heavily compressed spring ejects the plug. The clamp nut and receptacle remain in the aircraft fuel tank or missile. Special solenoids may be used for remote release of these mechanisms. Breakaway connector assemblies require relatively complex mechanism.

What is needed is a quick disconnect electrical connector coupling assembly which is reliable and can operate over an extended number of cycles. Breakaway coupling assemblies are designed to operate once. A quick disconnect coupling assembly may require versatility in operation as well as audible and visual indicators of its operation.

SUMMARY OF THE INVENTION

The present invention is a quick-disconnect electrical connector having plug and receptacle shells movable relative to each other along an axis and which include a bayonet-type mechanism having pins and spiral sector ramps. One of the plug and receptacle carries first and second concentrically disposed coupling members as well as one of said pins and spiral sector ramps. The first coupling member defines a recess within which is seated the other of said spiral sector and pins with the second coupling member defining a depression disposed opposite a portion of the recess.

The present invention is an electrical connector coupling assembly capable of quick-disconnect functioning. The quick-disconnect electrical connector coupling assembly comprises a cylincrical receptacle shell which has a plurality of fixed bayonet pins surrounding the outer surface of the receptacle shell. The receptacle shell has a polarizing means within its inner surface to correspond with the connector shell of a connector plug assembly so that the receptacle shell and the connector shell mate in a preselected orientation. The body of the connector plug assembly includes a second coupling ring which is coaxial with and surrounds a first coupling ring. The first coupling ring has a plurality of radially extended apertures, disposed along the cylindrical surface of the first coupling ring. Each aperture forms a recess surface positioned helically along the circumference of the the outer surface of the first coupling ring, and each aperture provides a seat for the positioning of a ramp spring segment and a floating land segment. The ramp spring is a resilient arcuate segment having radially extended guide rails protruding inward through the coupling ring apertures. The ramp spring segment includes opposingly disposed leaf spring portions integral with the ramp spring running along the sides of the ramp spring and disposed against the recess surface of the coupling ring, formed by the helical apertures. The ramp spring segment is reciprocally mounted between a protruding position and a retracted position. The bayonet pins of the receptacle shell travel along the guide rail of the ramp spring segment when the ramp spring segment is in the protruding position. The floating land segment is juxtaposed above the ramp spring and has a central ridge which interacts with the inner surface of the second coupling ring for positioning the floating land segment between two positions. The first position for the floating land segment is along the axially extended inner surface of the second ring, pushing down on the ramp spring so that the guide rail of the ramp spring protrudes radially inward, allowing the guide rail to abut the fixed bayonet pins of the receptacle shell as the plug assembly is mated with the receptacle shell. The quick-disconnect assembly also includes a wave spring that is normally biased to prevent the floating land segment from entering into a circular keyway of the second coupling ring. The wave spring thrusts the first coupling ring in a first axial direction away from the mating surface of the receptacle shell. A lanyard attachment ring attached to a lanyard is disposed about the forward-receptacle-facing end of the second coupling ring. When one pulls on the lanyard, the second coupling ring inner diameter shoulder compresses the wave spring allowing the floating land segment to enter the annular sloped keyway of the second coupling ring, so that the ramp spring segment recedes radially towards the second coupling ring allowing the connector shell to be quick-released from coupling with the receptacle shell.

In an alternative embodiment, the floating land segment and ramp spring may be of integral construction. In yet another embodiment, the ramp spring is composed of two portions, a central body and a pair of pivotally mounted leaf springs adjoining the central body portion affixed to the body.

DETAILED DESCRIPTION OF THE PREFERRED EMBODIMENT

Figure 1:
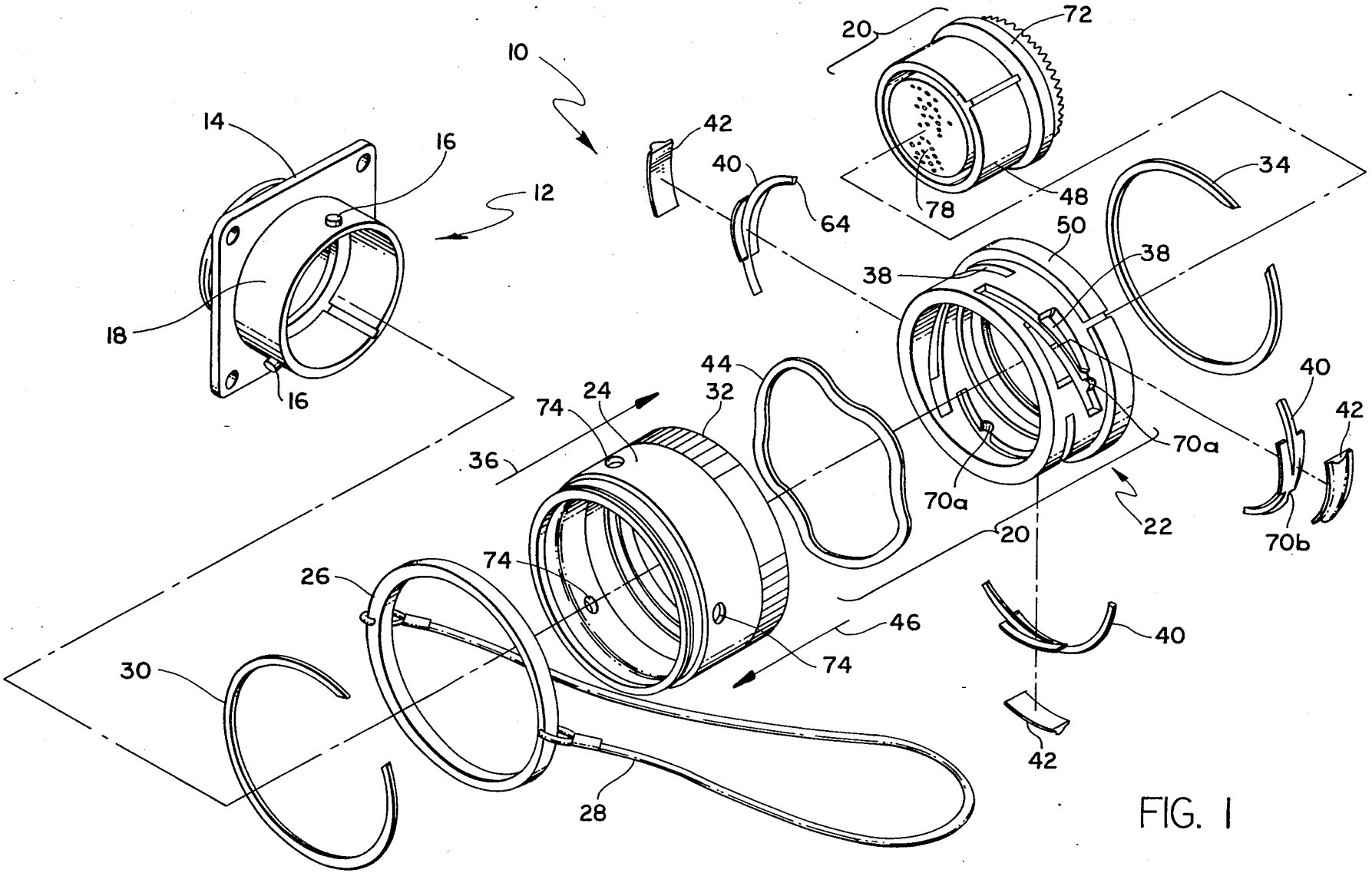
FIG. 1 is an exploded perspective view of the electrical connector assembly in accordance with the invention.

Referring initially to FIG. 1, a quick-disconnect electical connector coupling assembly is shown generally at 10 in exploded view. The receptacle shell 12 is integral with a receptacle plate 14 for mounting on an instrument control panel or other wall mountings. Three fixed bayonet pins 16 extend radially outward from the outer surface 18 of the receptable shell 12. The bayonet pins 16 comprise one element of the mechanism used to enable the electrical plug assembly 20 to be coupled to the receptacle shell 12.

Figure 2:
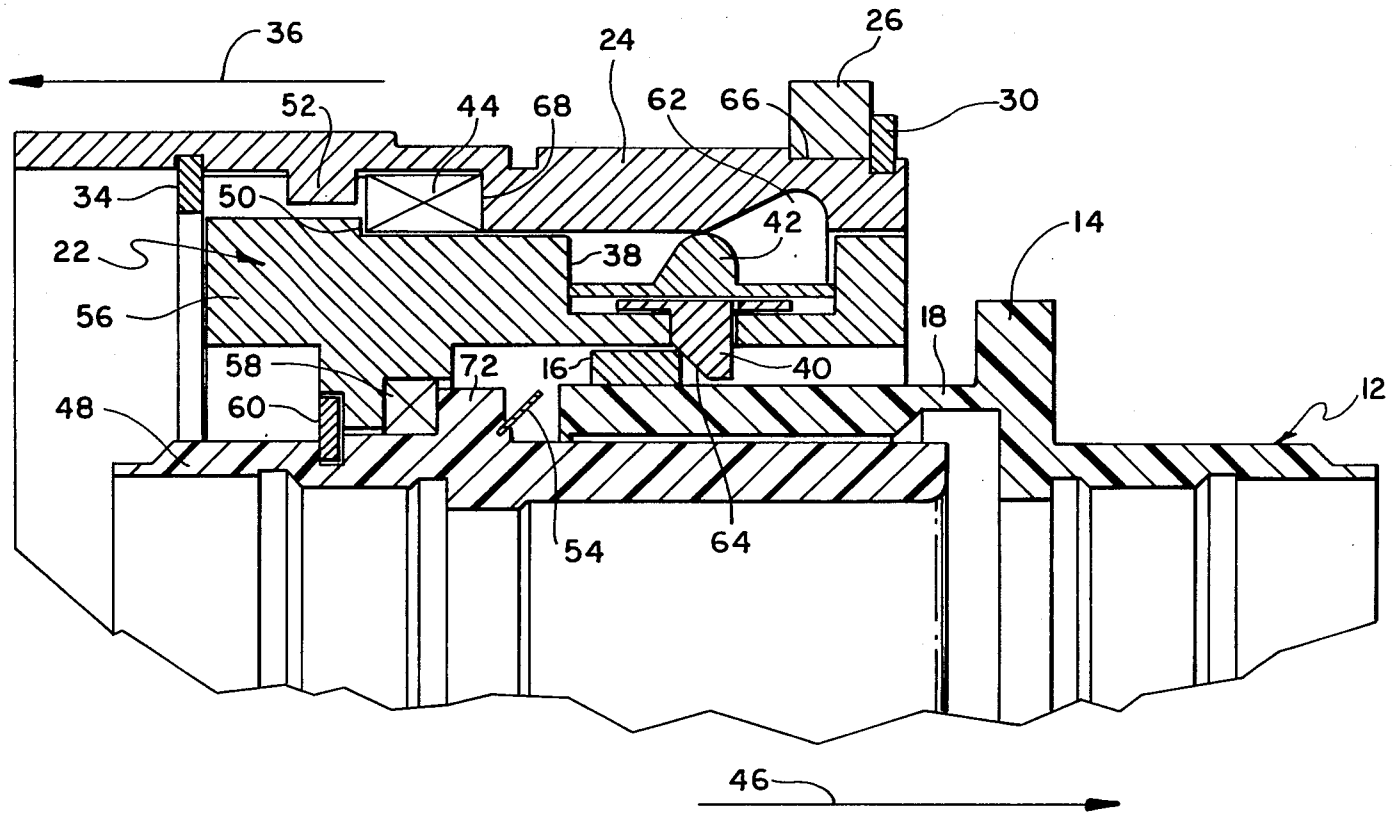
FIG. 2 is an axially directed cross-sectional view showing the electrical connector assembly of this invention in the fully coupled and mated position.
Figure 3:
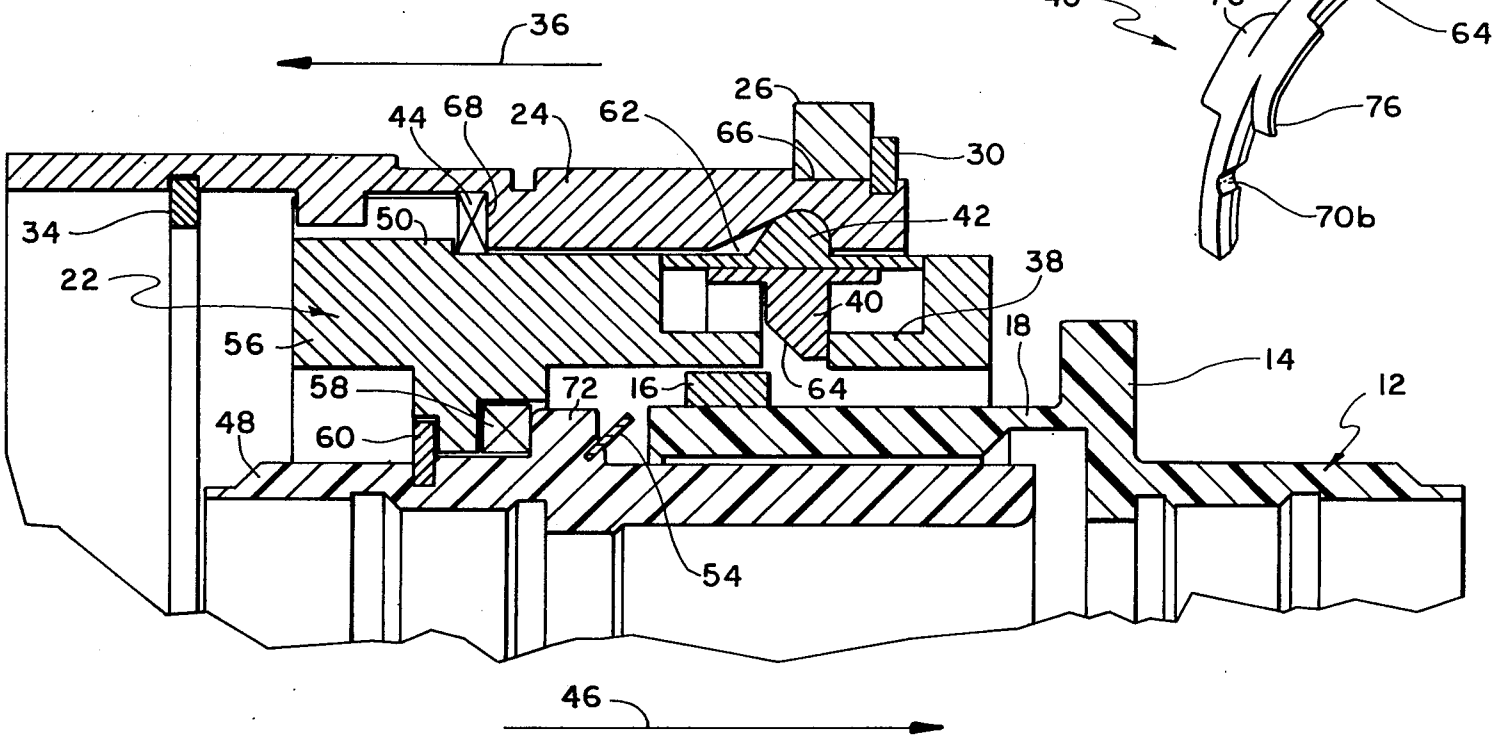
FIG. 3 is an axially disposed cross-sectional view of the electrical connector assembly of the invention showing the electrical plug assembly disconnected from the electrical receptacle shell.

FIG. 2 illustrates the electrical connector assembly as shown in FIG. 1 in the mated and locked position while FIG. 3 shows the same assembly in position after the lanyard has been pulled to activate the quick release mechanism of the connector constructed in accordance with the principles of the present invention. As is illustrated in FIGS. 2 and 3, a pair of coupling rings 22 and 24 are telescoped one within the other and are carried by the plug shell 48. A spring segment 40 carrying a land segment 42 is disposed between opposed surfaces of the coupling rings 22 and 24 and within an appropriate recess provided. A portion of the spring segment 40 extends through an opening in the recess and when the connector is in its locked position abuts the pin 16 to prevent disconnecting the plug and shell receptacles except by twisting as is common with a bayonet type connector. However, as more clearly seen in FIG. 3, when a force is applied to the outer coupling ring 24 as shown by the arrow 36 and additional recess is brought into position such that the spring segment 40 through appropriate biasing urges the land segment 42 into the additional recess thereby releasing the portion of the spring segment which initially abutted the pin 16. When in the position then as illustrated in FIG. 3, the plug and shell receptacles can quickly be disconnected simply by application of an appropriate axial force as illustrated by the arrow 46.

Referring now again to FIG. 1 and taking it in conjunction with FIGS. 2 and 3, a more detailed description of the various portions of the quick disconnect electrical connector coupling assembly constructed in accordance with the principles of the present invention will be given.

A first coupling ring 22 is telescoped within a second coupling ring 24 to form the body of the electrical plug assembly 20. A lanyard attachment ring 26 having a lanyard 28 affixed to the attachment ring 26 surrounds the second axially directed shoulder 66 of the second coupling ring 24. The lanyard attachment ring 26 is seated surrounding an annular second axially directed shoulder 66 of the second coupling ring 24, and secured by a first retainer ring 30. For ease of gripping, the second coupling ring 24 may have a knurled band 32 integral with the second coupling ring 24 at the first axially directed end of the second coupling ring 24. A second retainer ring 34 is mounted within the inner surface of the second coupling ring 24 at the knurled 32 end of the second coupling ring 24 after the first coupling ring 22 has been mounted within the second coupling ring 24. The second retainer ring 34 then acts to prevent displacement of the first coupling ring 22 in a first axial direction 36. The first coupling ring 22 has three mounting apertures 38, each of which provides a seat for one of the three ramp spring segments 40 and the floating land segments 42. A first wave spring 44 is disposed to normally bias the second coupling ring 24 in a second axial direction 46. When the first wave spring 44 is compressed by a force acting in the first axial direction 36, such as when an external force pulls lanyard 28 against lanyard attachment ring 26, the second coupling ring 24 is driven in a first axial direction 36. This movement of the second coupling ring 24 in a first axial direction 36 allows the floating land segment 42 to move upward and into the annular sloped keyway 62 (FIG. 2) along the inner surface of the second coupling ring 24.

FIG. 1 shows the connector plug shell 48 surrounding an insert pin matrix 78 and ready to be fitted within the first coupling ring 22. This radially extended motion of the floating land segment 42 releases the ramp spring segment 40 and allows the ramp spring segment 40 to retract from the mounting apertures 38 in a radial direction. Since the ramp spring segment 40 abuts the fixed bayonet pins 16 of the receptacle shell 12, the radially outward movement of the ramp spring segment 40 releases the fixed bayonet pin 16, thereby achieving a quick-disconnect and remote control decoupling of the electrical connector plug assembly 20 from the receptacle shell 12.

Turning to FIG. 2, a cross-sectional view of the receptacle shell 12 is shown surrounding the connector plug shell 48 which is fully mated and telescoped within the receptacle shell 12. Surrounding the outer surface of the receptacle shell 12 and forming an annular ring around the connector plug shell 48 is the first coupling ring 22. One of the fixed bayonet pins 16 is shown protruding axially outward from the surface of the receptacle shell 12. FIG. 2 shows that when the connector plug assembly 20 is fully mated with the receptacle shell 12, the bayonet pins 16 abut the ramp spring segments 40 and are held within detent grooves, 70*a* and 70*b*, (hereinafter referred to as "70") formed by the ramp spring segments 40 at the indentations 70*b* and the edges 70*a* of the mounting apertures 38.

The first wave spring 44 is shown as normally biased and expanded, abuting against a flanged shoulder 50 of the first coupling ring 22. The wave spring 44 also abuts an annular pressing shoulder 52 of the second coupling ring 24.

The second retainer ring 34 secures the body 56 of the first coupling ring 22 telescoped within the second coupling ring 24. A second wave spring 58 acts to bias the connector plug shell 48 in a second axial direction 46. The connector plug shell 48 is telescoped within the first coupling ring 22 and held by a third retainer ring 60. The EMI ring 54 is positioned on the opposite side of a radially flanged shoulder 72 of the connector plug shell 48 from the second wave spring 58.

To assure proper orientation for mating, the connector plug shell 48 is polarized to align in a preferred orientation within the inner surface of the receptacle shell 12, as shown in FIG. 2. In order to move the connector shell plug 48 in a second axial direction 46 for full engagement with the receptacle shell 12, one must rotate the electrical connector plug assembly 20 by grasping the knurled end 32 of the second coupling ring 24 so that the fixed bayonet pins 16 of the receptacle shell 12 travel along and abut the length of the ramp spring segment 40 until the detent groove 70 (FIG. 1) is reached. At that point, the visual indicator ports 74 show the position of the bayonet pins 16 within the detent groove 70. When fully mated (as shown in FIG. 2), the inner surface of the second coupling ring 24 is biased in a second axial direction 46 by the first wave spring 44 a sufficient distance so that the floating land segment 42 does not enter the annular sloped keyway 62 of the second coupling ring 24. So long as the floating land segment 42 is clear of the annular sloped keyway 62 of the second coupling ring 24, the ramp spring segment 40 is thrust radially against the outer surface of the receptacle shell 12 and pressed to the bottom of the mounting apertures 38, providing a guide rail 64 to direct the movement of the electrical plug assembly 20 rotationally about the fixed bayonet pin 16 of the receptacle shell 12. In this manner, the receptacle shell 12 and the electrical connector plug assembly 20 are joined in a secure mated connection.

With reference to FIG. 3, this view of the quick-disconnect electrical connector coupling assembly 10 (FIG. 1) shows the receptacle shell 12 initially disengaged from the electrical connector plug assembly 20. An external force acting in the first axial direction 36 pulls on the lanyard 28 and the lanyard attachment ring 26 (which is nestled in the annular shoulder 66 along the outer surface of the second coupling ring 24). As the lanyard attachment ring 26 is pulled in the first axial direction by remote control application of an external force on the lanyard 28 (FIG. 1), the second coupling ring 24 also moves in a first axial direction 36.

The first wave spring 44 is now compressed against the flanged shoulder 50 of the first coupling ring 22 by the first axially-directed shoulder 68 of the second coupling ring 24. At the same time that the first wave spring 44 is compressed by the shoulder 68, the annular sloped keyway 62 of the second coupling ring 24 receives the floating land segment 42 as the floating land segment 42 moves radially outward. Movement of the floating land segment 42 radially allows the land spring segment 40 to recede away from abutment and engagement with the fixed bayonet pins 16 of the receptacle shell 12.

The ramp spring segments 40 and the floating land segments 42 move in unison in an outward radial direction, having the effect of retracting the guide rails 64 of the ramp spring segments 40 into the mounting apertures 38 above the inner surface of the first coupling ring 22. As a result of the radially directed movement of the ramp spring segments 40 and floating land segments 42, the fixed bayonet pins 16 are no longer locked into the detent grooves 70. The electrical connector plug assembly 20 may now travel in a first axial direction 36 and be completely removed from mounting about the receptacle shell 12. In this manner, the electrical connector plug 20 is disengaged and decoupled from operational mating with the receptacle shell 12. As a result, an axially directed force, with no additional external torque, is sufficient to accomplish the decoupling action.

One will note that the second wave spring 58 secured between the connector shell plug 48 and the first coupling ring housing 56 is not affected by the movement of the second coupling ring 24 in a first axial direction 36.

Figure 4:
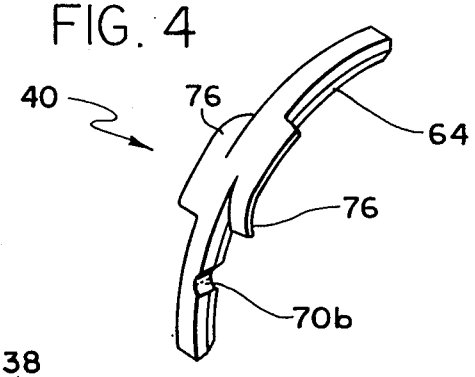
FIG. 4 is an enlarged perspective view of the ramp spring segment 40 of FIG. 1.

FIG. 4 is illustrative of the structural components of the ramp spring segment 40. This enlarged view reveals the arcuate shape of the resilient wings 76 of the ramp spring segment 40. The wings 76 serve to bias the ramp spring segment 40 in an outward radial direction. The indentations 70*b* of the ramp spring segments 40 defines a semi-circular outline, which in combination with the edges 70*a* of the mounting apertures 38, form the detent grooves 70.

In an alternative embodiment (not pictured) each ramp spring segment 40 and each floating land segment 42 define a single integral segment. Only fabrication and manufacturing techniques and costs make independent ramp spring segments 40 and floating land segments 42 a preferred embodiment; from an operational standpoint, a unitary ramp spring and floating land segment may replace the preferred two piece structure.

Alternatively, the ramp spring segment 40 may itself comprise two portions, a central body portion and a pair of pivotally mounted wings like the resilient wings 76 of FIG. 4 adjoining and affixed to the central body portion.

It should be noted that the preferred embodiment is illustrative of the a quick-disconnect electrical connector coupling assembly. The scope of the invention is not necessarily limited to the preferred embodiment. Many structural changes are possible and those changes are intended to be within the scope of this disclosure. For example, a lanyard 28 and a lanyard attachment ring 26 are not the only form of remote control available. The lanyard 28 could be attached directly to the second coupling ring 24. Quick-disconnect of the electrical connector coupling assembly 10 need not be achieved by a remote control mechanism at all. Consequently, the specific structural and functional details of the quick-disconnect electrical connector coupling assembly are merely representative, yet they are deemed to afford the best embodiment for purposes of disclosure and for providing support for the claims which define the scope of the present invention.

What is claimed is:

1. A quick-disconnect electrical connector coupling assembly, comprising:

a cylindrical receptacle shell, the receptacle shell having a plurality of fixed bayonet pins surrounding the outer surface of the receptacle shell;

a connector plug assembly including a connector shell, the connector shell surrounded by an axially disposed first coupling ring;

a second coupling ring surrounding the first coupling ring;

the first coupling ring having a plurality of radially extending apertures, disposed through the first coupling ring, each aperture forming a recessed surface positioned helically along the circumference of the outer surface of the first coupling ring, and each aperture providing a seat for the positioning of a ramp spring segment and a floating land segment;

the ramp spring segment being a resilient arcuate segment having a radially extending guide rail protruding radially through each of the apertures of the first coupling ring, the ramp spring segment having opposingly disposed leaf spring segments integral with the ramp spring running along the sides of the ramp spring segment disposed against the recessed surface of the first coupling ring, so that the ramp spring segment may reciprocate radially between a protruding guide rail position and a retracted position as the bayonet pin of the receptacle shell travels along the guide rail of the ramp spring segment;

the floating land segment being juxtaposed atop the ramp spring, having a central ridge which contacts the inner surface of the second coupling ring, for positioning the floating land segment between two positions, one position along the axially extended inner surface of the second ring and the second position keyed within a radially disposed annular keyway formed along the entire circumference of the second coupling ring;

a wave spring normally biased when the connector shell is engaged with the receptacle to prevent the floating land from entering into the annular keyway by thrusting the first coupling ring in a first axial direction away from the mating surface of the receptacle shell; and, the wave spring being axially compressed when the connector shell is disengaged from the receptacle, the compressed spring thrusting the first coupling ring in a second axial direction moving the floating land segment into a circular keyway of the second coupling ring, so that the ramp spring segment recedes radially towards the second coupling ring allowing the connector shell to be quick-released from coupling with the receptacle shell.

2. The quick-disconnect electrical connector coupling assembly of claim 1, including a lanyard attachment ring, the lanyard attachment ring surrounding the second coupling ring at the circular base end facing in the second axial direction, the lanyard attachment ring attached to at least two points along the circumference of the ring to a lanyard, so that the lanyard and the attachment ring can disconnect the connector plug assembly from the receptacle shell by remote control.

3. The quick-disconnect electrical connector coupling assembly of claim 1, wherein each ramp spring segment and each floating land spring segment form a unitary component seated within each of the apertures of the first coupling ring.

4. The quick-disconnect electrical connector coupling assembly of claim 1, wherein each ramp spring segment comprises:

a central body portion defining a radially disposed retractable guide rail for abutment with the receptacle shell fixed bayonet pins; and, a pair of pivotally mounted leaf springs disposed lengthwise and affixed on either side of said central body portion.

5. A quick-disconnect electrical connector coupling assembly, comprising:

a connector plug assembly for coupling to an electrical receptacle shell and connector assembly, the receptacle shell having a plurality of bayonet pins extending radially and positioned along the circumference of the outer surface of the receptacle shell;

the connector plug assembly comprising:

a first coupling ring having a plurality of reciprocally mounted retractable guide rails, each guide rail being seated within a recessed helically-shaped groove, with each of said guide rails comprising a ramp spring segment seated within the recessed helically-shaped groove, the ramp spring segment defining a part for the bayonet pins to travel along the ramp spring segment and a floating land segment which is movably positioned atop the ramp spring segment;

an outer second coupling ring, defining an annular sloped keyway for receiving the floating land segment of the guide rails along the inner surface of the end of the second coupling ring when said second coupling means is moved in a first axial direction away from said first coupling ring;

a means for clamping and holding the connector plug assembly coupled to the receptacle shell, said means normally biased to push the guide rails of the guide rails to protrude through the helically-shaped grooves for abutment with the bayonet pins of the receptacle shell;

the connector plug assembly being rotatably mounted about the receptacle shell, so that as the connector plug assembly is rotated with respect to the receptacle shell, the bayonet pins travel along the length of the guide rails, moving the connector plug assembly in a second axial direction;

the second coupling ring, when subjected to an applied external force exerted in a first axial direction, acts to compress the clamping and holding means so that the upper portion of the guide rails enter the annular sloped keyway along the inner surface circumference of the second coupling ring; and the guide rails, upon entering the annular sloped keyway of the second coupling ring, retract radially and are removed from abutment with the bayonet pins of the receptacle shell, allowing the connector plug assembly to quick-release from coupling with the receptacle shell.

6. A quick-disconnect electrical connector coupling assembly as in claim 5, wherein the means for clamping and holding the connector plug assembly is an annular wave spring surrounding the first coupling ring and abutting an annular pressing shoulder of the second coupling ring.

7. A quick-disconnect electrical connector coupling assembly as in claim 5, including a lanyard attachment ring which surrounds the outer surface of the second coupling ring, having a lanyard affixed to the circumference of said lanyard attachment ring for remote control of the quick-disconnect function of the electrical connector coupling assembly.

8. A quick-disconnect electrical connector coupling assembly as in claim 5, wherein the ramp spring segment further comprises:

a central body portion which abuts the bayonet pins of the receptacle shell; and, a pair of pivotally mounted leaf springs disposed lengthwise, adjoined to each other at their respective midpoints, and affixed on either side of the central body portion.

9. A quick-disconnect electrical connector coupling assembly, including a receptacle shell having an outer surface with a plurality of radially outward extending bayonet pins attached thereto;

the receptacle shell adapted for coupling to a connector plug assembly, said connector plug assembly comprising:

a first coupling ring secured and telescoped within a second coupling ring;

the first coupling ring having retractable means for coupling the connector plug assembly to the bayonet pins of the receptacle shell;

the retractable means being resiliently mounted within the first coupling ring so that the connector plug assembly is normally securely mated to the receptacle shell; but when an externally axially directed force is applied to the second coupling ring, the second coupling ring interacts with the first coupling ring so that the means for coupling the connector plug assembly retracts and disengages the connector plug assembly from the bayonet pins of the receptacle shell, quickly disconnecting the connector plug assembly from the retractable shell;

wherein said retractable means comprises:

a plurality of elongated helically-shaped retractable members seated within apertured mountings of the first coupling ring, each member defining an inward radially extending guide rail for abutment with the bayonet pins of the receptacle shell;

each retractable member further defining a sloped top extending radially outward for keying into an annular sloped key way within the inner surface of the second coupling ring;

each retractable member being resiliently biased normally to abut the bayonet pins, and seated within the apertured mountings for reciprocal movement between a coupled and a retracted position; and wherein each retractable member includes:

a pair of arcuate resilient wings integrally mounted lengthwise along the sides of the retractable member, providing reciprocal mounting for the retractable member so that said member is biased to normally abut the bayonet pins of the receptacle shell.

10. The quick-disconnect electrical connector of claim 9, wherein each retractable member comprises:

a ramp spring segment along which sides said resilient wings are integrally mounted, which spring segments are seated within the apertured mounting of the first coupling ring, the ramp spring segment defining the guide rails for abutment with the bayonet pins of the receptacle shell;

a floating land segment which defines said sloped top of said retractable member and which is positioned atop the ramp spring segment, movably mounted for positioning within an annular sloped keyway of the second coupling ring; and wherein the ramp spring segment and the floating land segment operatively associated to function as a unitary retractable member.

11. A quick disconnect electrical coupler for a two-part multiple pin type electrical connector comprising:

a receptacle mount secured about one part of said multiple pin type electrical connector which is formed with an outwardly extending tubular portion;

a plug mount secured about a second part of said multiple pin type electrical connector which is formed with an outwardly extending tubular portion concentrically mountable with said tubular portion of said receptacle mount;

tubular coupling means rotatably positionable about said tubular portions of said plug mount and said receptacle mount when each of said mount tubular portions are concentrically positioned with respect to each other for releasably coupling said receptacle mount and said plug mount to each other, said coupling means being releasably secured to one of either of said plug mount or said receptacle mount tubular portion, with said other of said plug or receptacle mount tubular portion formed with one or more bayonet pins extending radially outward from a peripheral surface of said tubular portion, said coupling means rotatably positionable about that tubular portion of said plug mount or receptacle mount which is formed with said bayonet pins, said coupling means further including at least a first catch means which is formed to receive a portion of said bayonet pin and which catch means includes an elastically deformable element which is resiliently biased in a first radially inward direction and formed with a bearing surface upon which said bayonet pin bears when received therein, said catch means being angularly positioned with respect to the direction said coupling means is rotated to insure that said bayonet pin will continuously bear against said elastically deformable element, thereby causing said coupling means to grip said mount tubular portion and couple together said plug mount and said receptacle mount; and catch release means integrally formed with said tubular coupling means and associated with said catch means elastically deformable element which is operable to effect a radially outward positioning of said catch means elastically deformable element, thereby allowing said coupling means to disengage said plug and receptacle mount tubular portions from each other.

12. The connector of claim 11 wherein said coupling means comprises two concentrically mounted tubular sleeves which are secured for axially movement in two opposing directions with respect to each other and wherein said catch means elastically deformable element is an arcuately configured spring having a portion thereof defining said bearing surface, said catch means further comprising an aperture formed in an innermost of said coupling means tubular sleeves which is at least partially alignable with said aperture, a portion of said arcuately configured spring at least partially receivable in said aperture and recess, said recess formed with at least two areas of differing depths into which at least said portion of said spring can be selectively placed, said spring portion being selectively positionable by the selective operation at said release means into a first of said recess depths to cause said spring bearing surface to bear up against said bayonet pin and said spring portion being selectively positionable by the selective operation of said release means into a second of said recess depths to allow said spring bearing surface to move radially outward away from said bayonet pin and thus allow said coupling means to release said plug mount and said receptacle mount from each other.

13. The connector of claim 12 wherein said spring bearing surface has defined therein a cut-out for receiving said bayonet pin when said pin is placed into communication therewith as said pin moves across said surface by the rotation of said coupling means.

14. The connector of claim 13 wherein said release means includes supporting means to support said sleeves of said coupling means to be normally biased in an axial direction away from each other which positions said springs in said first of said recess depths and allowing for said sleeves to be operatively moved axially towards each other which will position said spring in said second recess depth.

* * * * *